US010393003B2

(12) United States Patent
Nowka et al.

(10) Patent No.: US 10,393,003 B2
(45) Date of Patent: Aug. 27, 2019

(54) STAMPED AERODYNAMIC DEFLECTOR FOR VEHICLE MUFFLER

(71) Applicant: Ford Global Technologies, LLC, Dearborn, MI (US)

(72) Inventors: Erich James Nowka, Ann Arbor, MI (US); Shawn D. Norman, Jackson, MI (US); Kerry Timothy Havener, Canton, MI (US); Steven A. Hornby, Ypsilanti, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 176 days.

(21) Appl. No.: 15/428,862

(22) Filed: Feb. 9, 2017

(65) Prior Publication Data

US 2018/0223718 A1 Aug. 9, 2018

(51) Int. Cl.

| | |
|---|---|
| ***F01N 13/18*** | (2010.01) |
| ***F01N 13/00*** | (2010.01) |
| ***F01N 1/00*** | (2006.01) |

(52) U.S. Cl.

CPC ..... *F01N 13/1872* (2013.01); *F01N 1/00* (2013.01); *F01N 13/001* (2013.01); *F01N 13/1894* (2013.01); *F01N 2260/00* (2013.01); *F01N 2260/20* (2013.01)

(58) Field of Classification Search

CPC .. F01N 13/1872; F01N 13/1888; F01N 13/14; F01N 13/141; F01N 2260/20; F01N 2260/18; F01N 2510/00; B60K 13/04

See application file for complete search history.

(56) References Cited

U.S. PATENT DOCUMENTS 4,489,806 A * 12/1984 Shimomura ..... B62D 35/005 180/313
4,860,853 A * 8/1989 Moring, III ..... F01N 1/02 181/282
4,909,348 A * 3/1990 Harwood ..... B60K 13/04 181/228

(Continued)

FOREIGN PATENT DOCUMENTS

CN 204113411 U * 1/2015 ..... F01N 13/00
DE 4319281 A1 * 12/1994 ..... B60K 13/04

(Continued)

*Primary Examiner* — Edgardo San Martin
(74) *Attorney, Agent, or Firm* — LeClairRyan

(57) ABSTRACT

A two-piece, stamped muffler having an integrally-attached aerodynamic shield having a flat bottom shape is disclosed. The muffler may be formed with a substantially flat lower surface. The aerodynamically-improved muffler set forth herein is provided as an aerodynamic shield that is incorporated into an extended flange provided in the shell blank, as a deflector that is attached to a muffler lower shell body and the clamshell flange such as by welding, that is separately attached to the clamshell flange only such as by welding, or that is separately attached to the lower shell only, again possibly by welding. For dual stamped mufflers, the shield may be used jointly with an incremental shield separate from, or integrated into, the spare tire well to connect the twin dual muffler shields to achieve vehicle aerodynamic requirements. A muffler having the aerodynamic shield deflects underbody air flow outside of the rear fascia cavity.

18 Claims, 18 Drawing Sheets

(56) References Cited

U.S. PATENT DOCUMENTS

| | | | | | |
|---|---|---|---|---|---|
| 4,915,389 | A * | 4/1990 | Ihara | A63B 37/0004 | 473/379 |
| 4,932,612 | A * | 6/1990 | Blackwelder | B64C 21/025 | 244/130 |
| 5,023,958 | A * | 6/1991 | Rotzin | A42B 3/0493 | 2/411 |
| 5,280,142 | A | 1/1994 | Keller | | |
| 5,281,778 | A | 1/1994 | Cheladyn et al. | | |
| 5,909,782 | A * | 6/1999 | Pluff | B60K 13/02 | 138/39 |
| 6,484,971 | B2 * | 11/2002 | Layukallo | B64C 9/00 | 244/130 |
| 7,331,611 | B2 * | 2/2008 | Kusu | B60K 13/04 | 180/309 |
| 7,942,240 | B2 * | 5/2011 | Olsen | F01N 1/084 | 181/238 |
| 8,827,035 | B2 * | 9/2014 | Ross | F01N 13/1888 | 181/238 |
| 9,283,999 | B2 * | 3/2016 | Wolf | B62D 35/007 | |
| 9,441,512 | B1 | 9/2016 | Collareno et al. | | |
| 9,464,557 | B2 * | 10/2016 | Hornby | F01N 13/00 | |
| 2008/0098721 | A1 * | 5/2008 | Liu | F01N 13/14 | 60/272 |
| 2014/0251241 | A1 | 9/2014 | Tajima | | |

FOREIGN PATENT DOCUMENTS

| | | | | |
|---|---|---|---|---|
| DE | 19919280 | A1 * | 11/2000 | B60K 13/04 |
| DE | 102012006818 | A1 * | 10/2013 | F01N 13/001 |
| DE | 102015002612 | A1 | 8/2015 | |
| FR | 2981692 | A1 * | 4/2013 | F01N 13/1816 |

* cited by examiner

STAMPED AERODYNAMIC DEFLECTOR FOR VEHICLE MUFFLER

TECHNICAL FIELD

The disclosed inventive concept relates generally to muffler systems for automotive vehicles. More particularly, the disclosed inventive concept relates to muffler systems that incorporate an aerodynamic shield to reduce vehicle aerodynamic drag to thereby improve design efficiency and reduce operating expenses.

BACKGROUND OF THE INVENTION

It is known in the automotive industry that vehicle drag is one of the greatest design challenges to be overcome. A moving vehicle displaces surrounding air while in motion. The resulting resisting force is referred to as aerodynamic drag. Automobile designers seek to reduce the amount of drag on a vehicle insofar as this force has an increasingly detrimental impact on vehicle fuel economy as the vehicle's speed is increased. As vehicle velocity increases, the amount of vehicle aerodynamic drag as a result of the increased airflow around the vehicle increases. As aerodynamic drag increases, more energy is required to move the vehicle.

It is also known in the automotive industry that the frontal area of the vehicle and the drag coefficient are the two main characteristics that determine aerodynamic drag. The drag coefficient indicates the degree to which a vehicle resists travel through surrounding air. Accordingly, to increase efficiency, designers are required to reduce the vehicle's drag coefficient. This goal has been achieved in part by removing such external components as mud flaps, roof racks and antennae while making necessary components, such as mirrors and front bumpers, more aerodynamic.

While many of these steps have provided a degree of satisfaction in achieving reduction of the drag coefficient related to vehicle body design, reducing the vehicle's drag coefficient generated by the underside of the vehicle is more challenging. To this end, some success has been achieved by providing a dynamic system whereby the body of the vehicle is lowered relative to the wheels, thereby restricting the amount of air that is allowed to pass between the vehicle and the roadway. Another strategy is to provide an under tray that covers all or some of the underside of the vehicle, thus preventing air from being trapped. Both of these efforts achieve some success in reducing the vehicle's drag coefficient. However, the latter approach requires relatively expensive frame features while the former approach, while being common in racing vehicles, is impractical for the typical family vehicle for several reasons, including vehicle ground clearances under normal operations.

As an alternative to lowering the vehicle during operation or providing an under tray, vehicle designers realize that drag reduction of underbody components may be dealt with on a component level. One such approach has been to consider a redesign of all or part of the vehicle's exhaust components. For example, U.S. Pat. No. 9,464,557, issued on Oct. 11, 2016, for MUFFLER SHIELD AND MUFFLER ASSEMBLY EMPLOYING THE SAME and assigned to the same assignee as the present application and incorporated by reference herein, provides a muffler shield including a shield body that extends in a longitudinal direction and defines a middle portion positioned between first and second side portions along a transverse direction. A cross-section of the middle portion and at least one of the first and second side portions respectively define a middle profile and a side profile shorter than the middle profile.

While this reference represents an improvement in the reduction of a vehicle's drag coefficient by reducing aerodynamic turbulence associated with the muffler, other approaches to reducing vehicle drag related to the muffler are possible.

SUMMARY OF THE INVENTION

The disclosed inventive concept provides a further achievement in efforts to reduce the vehicle's drag coefficient related to the exhaust system. The disclosed inventive concept provides for the efficient integration of an aerodynamic shield with a muffler in which the shield has a unique flat bottom shape. The shield is fixed to the muffler in such a way so as to both improve design efficiency and reduce assembly and operating costs.

The disclosed inventive concept is directed to the provision of an aerodynamic shield for use with a two-piece or clamshell stamped muffler assembly. The stamped muffler according to the disclosed inventive concept may be formed with a substantially flat lower surface, thus providing a greater aerodynamic benefit than a conventional rolled oval muffler. This aerodynamic function is significantly improved when an aerodynamic shield is added to deflect under body airflow away from the muffler to the fascia cavity. Because of the peculiarity of the stamped muffler, this arrangement requires a different design in which the aerodynamic shield is integrated into the muffler.

The disclosed inventive concept is applicable to either single transverse stamped mufflers or dual stamped mufflers. The aerodynamically-improved muffler set forth herein is provided as an aerodynamic shield that is incorporated into an extended flange provided in the shell blank, as a deflector that is attached to a muffler lower shell body and the clamshell flange such as by welding, that is separately attached to the clamshell flange only such as by welding, or that is separately attached to the lower shell only, again possibly by welding.

For dual stamped mufflers, the shield concept may be used jointly with an incremental shield separate from, or integrated into, the spare tire well to connect the twin dual muffler shields as required to achieve vehicle aerodynamic requirements.

Regardless of the configuration, the flat area of the stamped muffler set forth herein is advantageous over prior designs in that it replaces a separate add-on aerodynamic shield. This combined function results in significant cost savings. The inherent aerodynamic function of the flat bottomed stamped muffler can be significantly improved with the addition of an extended aerodynamic shield to deflect under body air flow outside of the rear fascia cavity. This improves overall vehicle aerodynamics and helps to reduce the vehicle's drag coefficient.

The above advantages and other advantages and features will be readily apparent from the following detailed description of the preferred embodiments when taken in connection with the accompanying drawings.

BRIEF DESCRIPTION OF THE DRAWINGS

For a more complete understanding of this invention, reference should now be made to the embodiments illustrated in greater detail in the accompanying drawings and described below by way of examples of the invention wherein.

DETAILED DESCRIPTION OF THE PREFERRED EMBODIMENT

Figure 1:
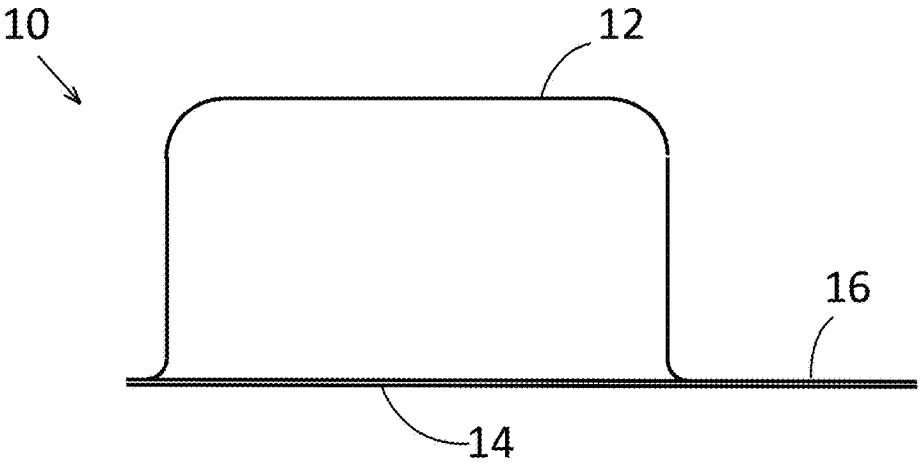
FIG. 1 is a side view of an embodiment of the stamped muffler having an air deflecting shield according to the disclosed inventive concept.

In the following figures, the same reference numerals will be used to refer to the same components. In the following description, various operating parameters and components are described for different constructed embodiments. These specific parameters and components are included as examples and are not meant to be limiting.

The accompanying figures show various related interpretations of the disclosed inventive concept which provides a two-piece aerodynamic muffler having a stamped upper portion attached to a stamped lower portion and an air deflecting structure associated with the stamped lower portion. The air deflecting structure may be a substantially flat flange or may be a surface feature formed on the underside of the stamped lower portion such as a series of parallel ridges or a series of dimples. It is to be understood that the concepts illustrated in the accompanying figures and discussed in relation thereto are not intended as being limiting as certain variations, such as the number and placement of the flange, the length and position of the extension, and the depth, number and placement of the dimples may be varied without deviating from the disclosed inventive concept as discussed hereafter.

Referring to FIG. 1, a side view of an embodiment of the stamped muffler having an air deflecting shield according to the disclosed inventive concept is illustrated and is generally shown as a stamped, transverse muffler 10. The stamped, transverse muffler 10 includes an upper stamping 12 having attached thereto a stamped lower flat or substantially flat base 14. A flat air deflecting shield 16 extends vehicle rearward from the end of the flat or substantially flat base 14. The air deflecting shield 16 creates an aerodynamic shield effect when the vehicle is moving.

Figure 2:
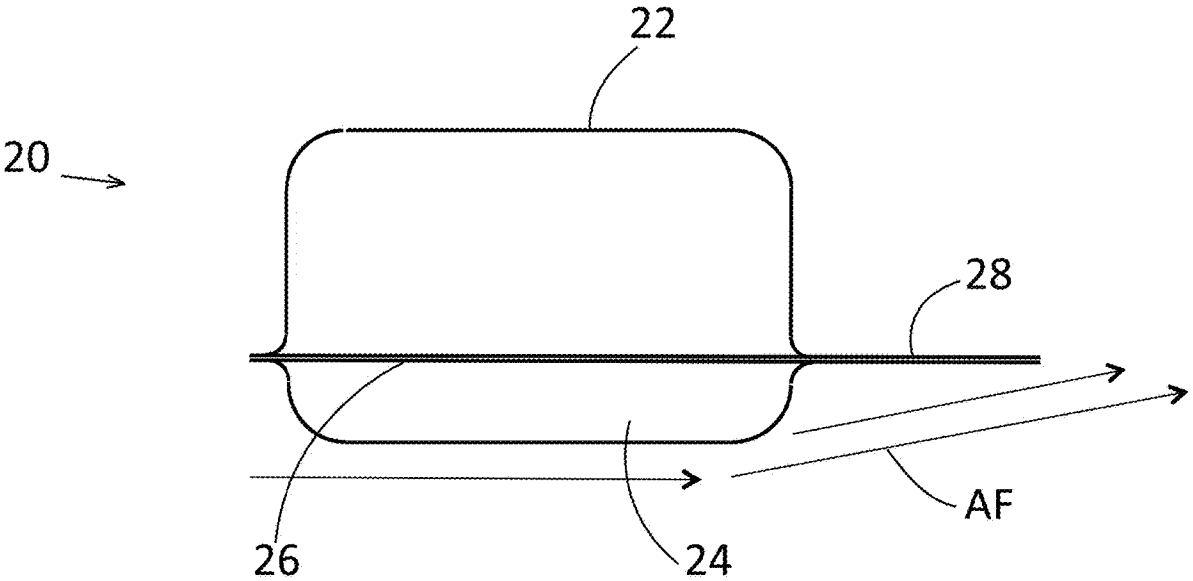
FIG. 2 is a side view of another embodiment of the stamped muffler having an air deflecting shield according to the disclosed inventive concept.

Referring to FIG. 2, a side view of another embodiment of the stamped muffler having an air deflecting shield according to the disclosed inventive concept is illustrated and is generally shown as a stamped, transverse muffler 20. The stamped, transverse muffler 20 includes an upper stamping 22 having attached thereto a lower shallow stamping 24. The upper stamping 22 and the lower shallow stamping 24 are joined at a peripherally extending mating flange 26. A flat air deflecting shield 28 extends vehicle rearward from the end of the mating flange 26. The air deflecting shield 28 creates an aerodynamic shield effect when the vehicle is moving as illustrated by the air flow AF.

Figure 3:
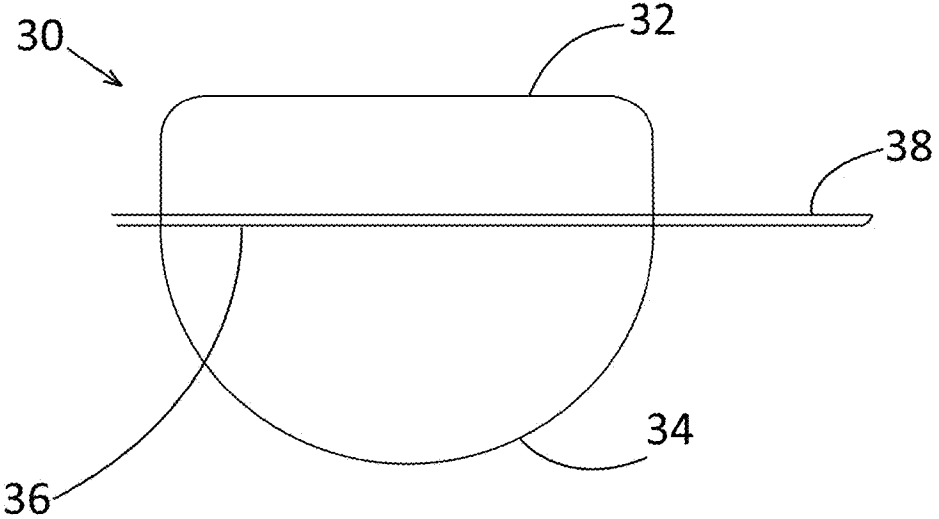
FIG. 3 is a side view of another embodiment of the stamped muffler having an air deflecting shield according to the disclosed inventive concept.

Referring to FIG. 3, a side view of another embodiment of the stamped muffler having an air deflecting shield according to the disclosed inventive concept is illustrated and is generally shown as a stamped, transverse muffler 30. The stamped, transverse muffler 30 includes an upper stamping 32 having a substantially flat upper surface having attached thereto a deep drawn lower stamping 34 having a domed configuration. The upper stamping 32 and the deep drawn lower stamping 34 are joined at a peripherally extending mating flange 36. A flat air deflecting shield 38 extends vehicle rearward from the end of the mating flange 36.

Figure 4:
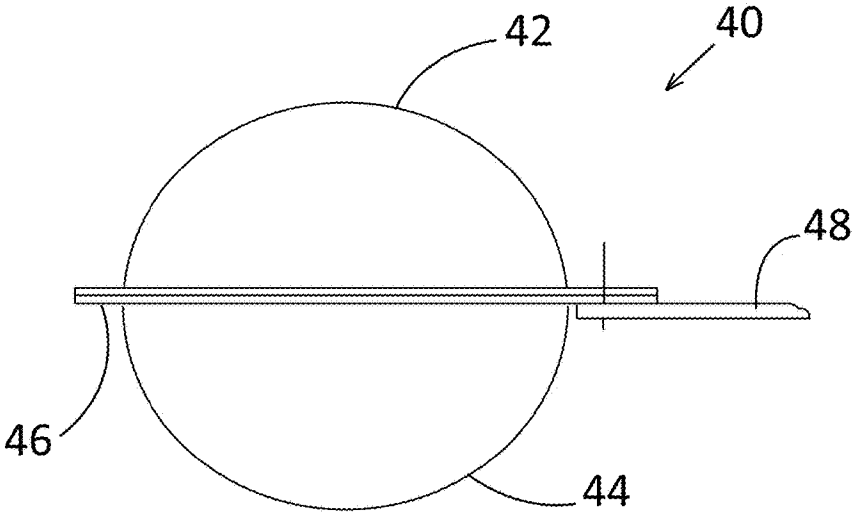
FIG. 4 is a side view of another embodiment of the stamped muffler having an air deflecting shield according to the disclosed inventive concept.

Referring to FIG. 4, a side view of another embodiment of the stamped muffler having an air deflecting shield according to the disclosed inventive concept is illustrated and is generally shown as a stamped, transverse muffler 40. The stamped, transverse muffler 40 includes a deep drawn upper stamping 42 having a domed configuration having attached thereto a deep drawn lower stamping 44 that also has a domed configuration. The deep drawn upper stamping 42 and the deep drawn lower stamping 44 are joined at a peripherally extending mating flange 46. A flat air deflecting shield 48 is attached, such as by welding, to the end portion of the mating flange 46. The flat air deflecting shield 48 thus extends vehicle rearward from the end of the mating flange 46.

As set forth in FIGS. 1 through 4, the disclosed inventive concept has application to transverse mufflers that include an air deflecting shield. Additional transverse mufflers having alternative air deflecting configurations are possible and such configurations are discussed below. However, it is to be understood that the air deflecting shield of the disclosed inventive concept may also find utility with dual muffler exhaust systems of the types illustrated in FIGS. 5, 6 and 7.

Figure 5:
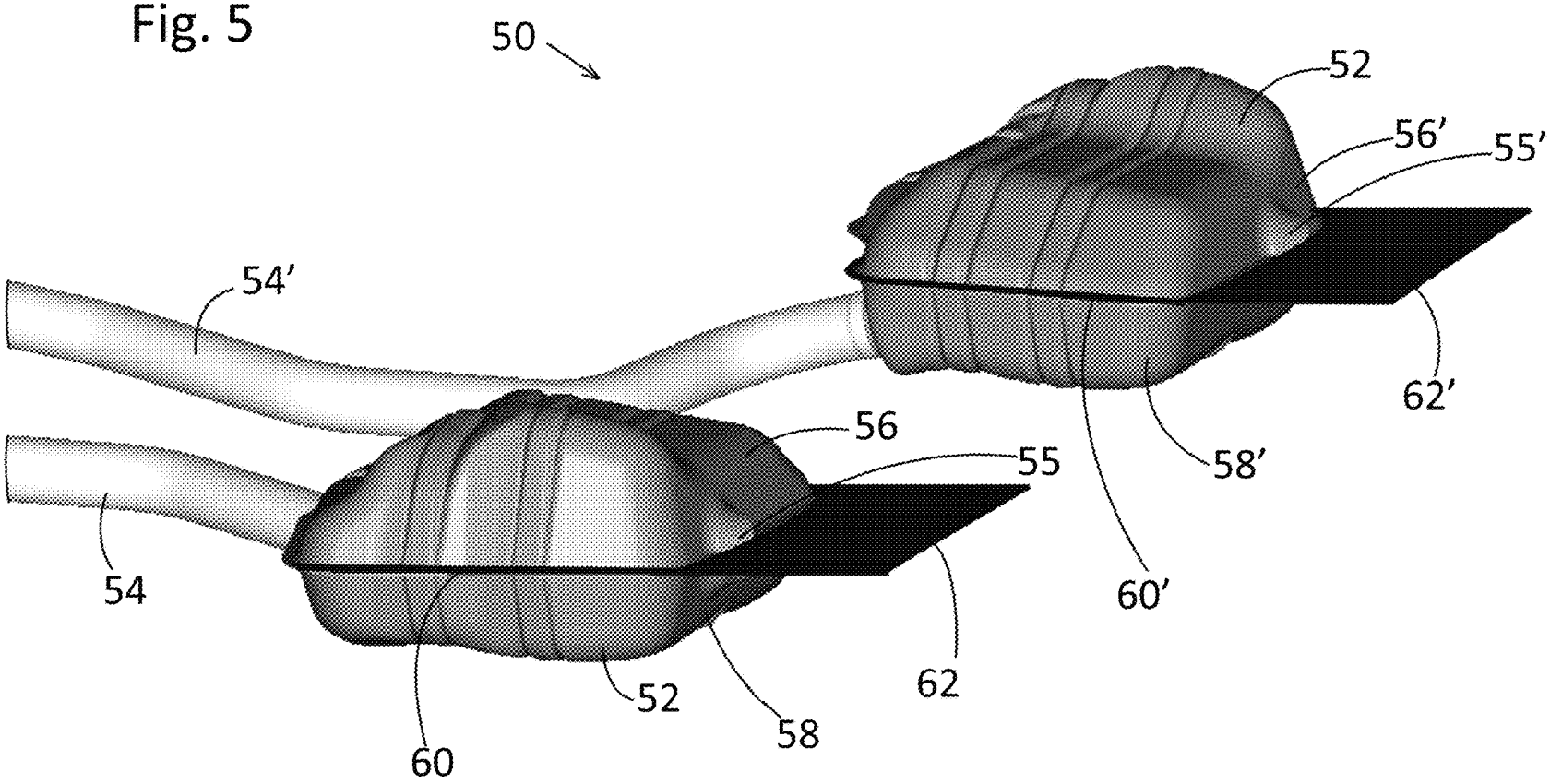
FIG. 5 is a perspective view of an embodiment of the disclosed inventive concept that includes a pair of stamped mufflers with each muffler having an air deflecting shield.

Referring to FIG. 5, a perspective view of a dual muffler embodiment of the disclosed inventive concept is generally illustrated as a dual muffler assembly 50. The dual muffler assembly 50 includes a first muffler 52 having a first exhaust inlet pipe 54 and a first exhaust outlet 55. The first muffler 52 further includes a first upper stamping 56 and a first lower stamping 58. The first upper stamping 56 and the first lower stamping 58 are joined at a first extended flange 60. A first air deflecting shield 62 extends from and is an integral part of the rearward end of the first extended mating flange 60. The dual muffler assembly 50 further includes a second muffler 52' having a second exhaust inlet pipe 541 and a second exhaust outlet 55'. The second muffler 52' further includes a second upper stamping 56' and a second lower stamping 58'. The second upper stamping 56' and the second lower stamping 58' are joined at a second extended flange 60'. A second air deflecting shield 62' extends from and is an integral part of the rearward end of the second extended mating flange 60'.

Figure 6:
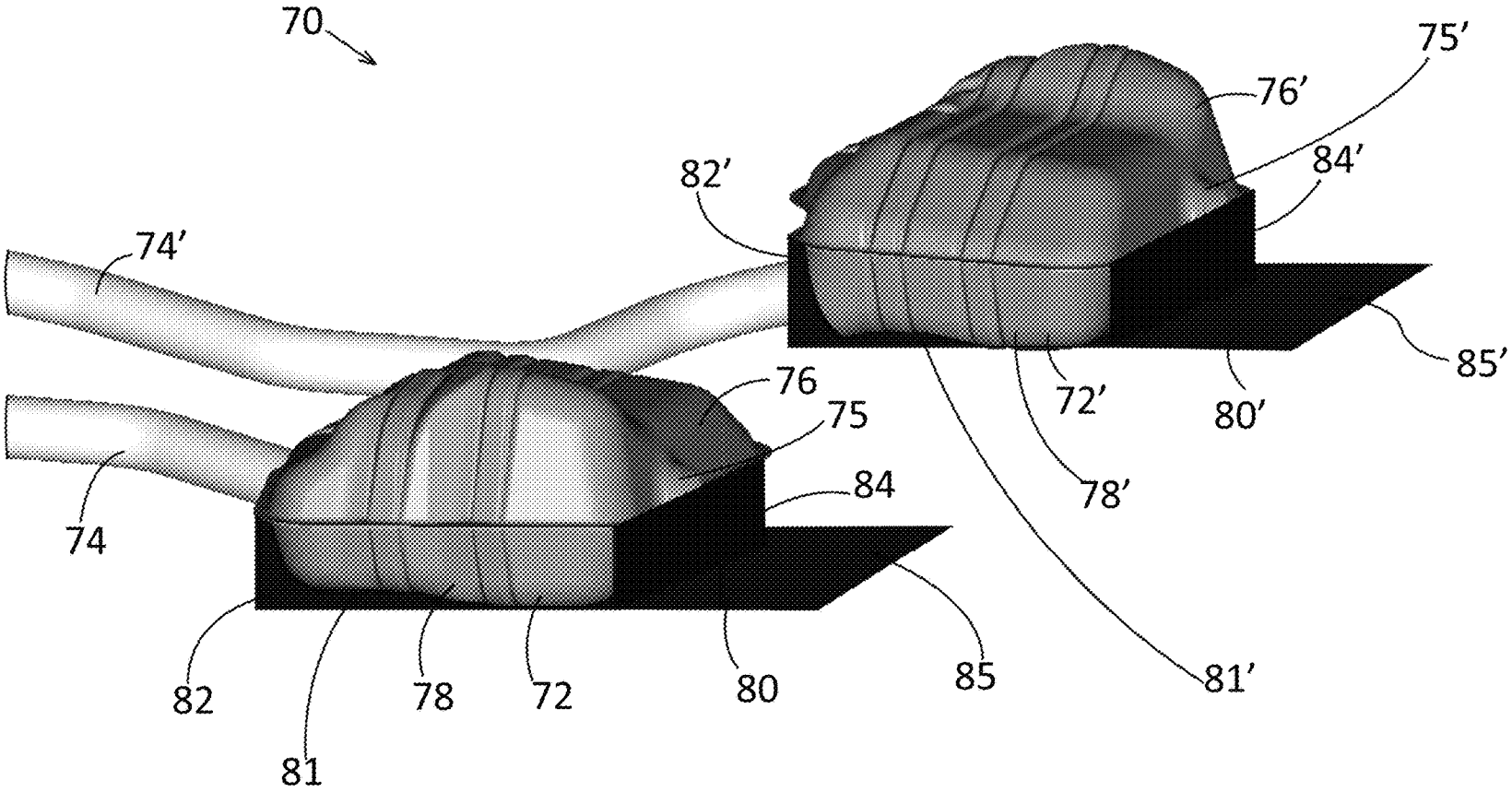
FIG. 6 is a perspective view of another embodiment of the disclosed inventive that includes a pair of stamped mufflers with each muffler having an air deflecting shield.

Referring to FIG. 6, a perspective view of a dual muffler embodiment of the disclosed inventive concept is generally illustrated as a dual muffler assembly 70. The dual muffler assembly 70 includes a first muffler 72 having a first exhaust inlet pipe 74 and a first exhaust outlet 75. The first muffler 72 further includes a first upper stamping 76 and a first lower stamping 78. A first air deflecting shield 80 is fitted to the first lower stamping 78. The first air deflecting shield 80 includes a first air deflecting base wall 81, a first air deflecting shield front wall 82, a first air deflecting shield back wall 84, and a first rearward extending air deflecting flange 85. One or more of the base wall 81, the front wall 82, and the back wall 84 is attached to the first lower stamping 78 by, for example, welding.

The dual muffler assembly 70 of FIG. 6 further includes a second muffler 72' having a second exhaust inlet pipe 74' and a second exhaust outlet 75'. The second muffler 72' further includes a second upper stamping 76' and a second lower stamping 78'. A second air deflecting shield 80' is fitted to the second lower stamping 78'. The second air deflecting shield 80' includes a second air deflecting base wall 81', a second air deflecting shield front wall 82', a second air deflecting shield back wall 84', and a second rearward extending air deflecting flange 85'. One or more of the base wall 81', the front wall 82', and the back wall 84' is attached to the second lower stamping 78' by, for example, welding.

Figure 7:
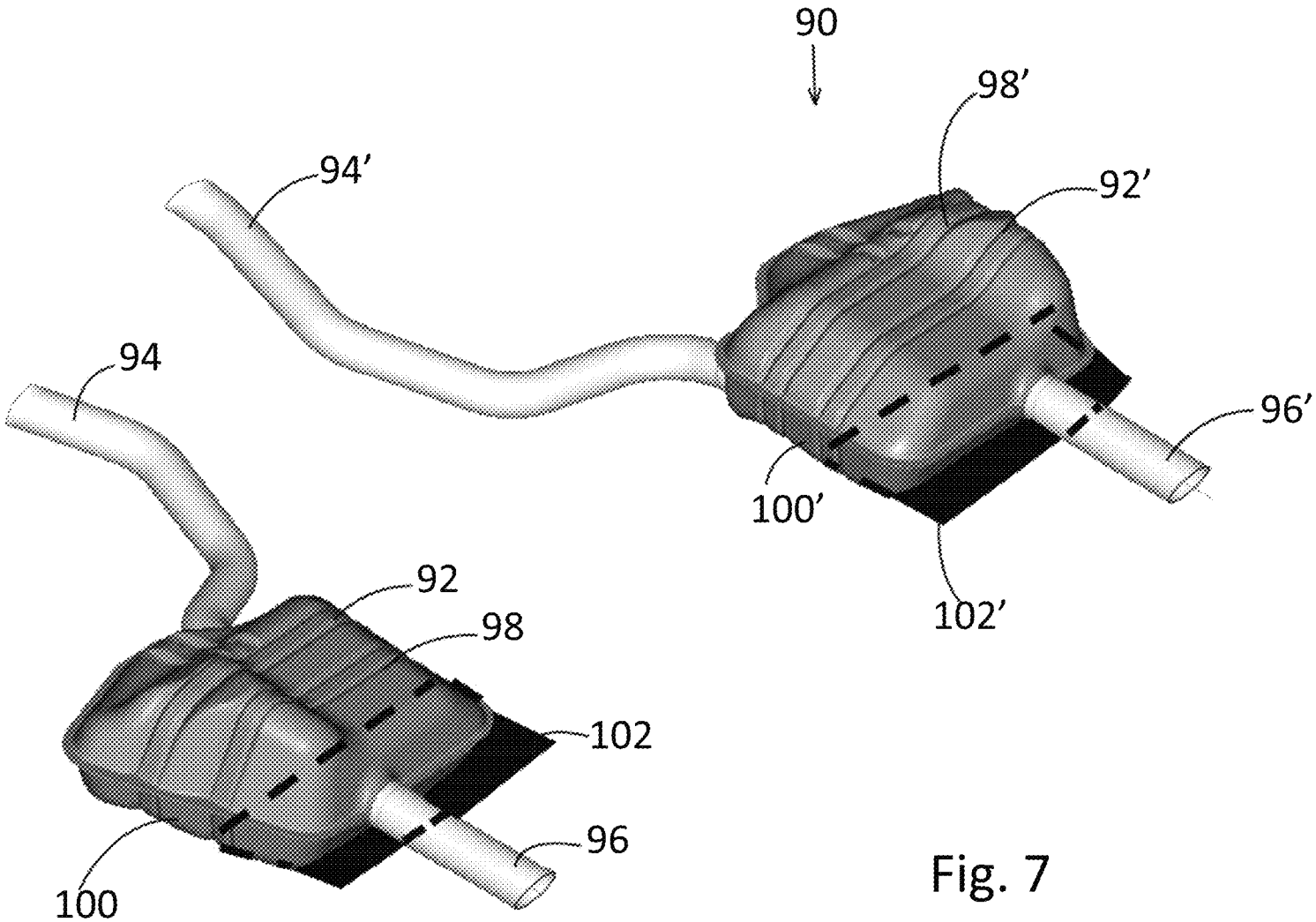
FIG. 7 is a perspective view of another embodiment of the disclosed inventive concept that includes a pair of stamped mufflers with each muffler having an air deflecting shield.

Referring to FIG. 7, a perspective view of a dual muffler embodiment of the disclosed inventive concept is generally illustrated as a dual muffler assembly 90. The dual muffler assembly 90 includes a first muffler 92 having a first exhaust inlet pipe 94 and a first tailpipe 96. The first muffler 92 further includes a first upper stamping 98 and a first lower stamping 100. A cantilevered first air deflecting shield 102 is attached to the underside of the first lower stamping 100 by, for example, welding. The dual muffler assembly 90 further includes a second muffler 92' having a second exhaust inlet pipe 94' and a second tailpipe 96'. The second muffler 92' further includes a second upper stamping 98' and a second lower stamping 100'. A cantilevered second air deflecting shield 102' is attached to the underside of the second lower stamping 100' also by, for example, welding.

Figure 8:
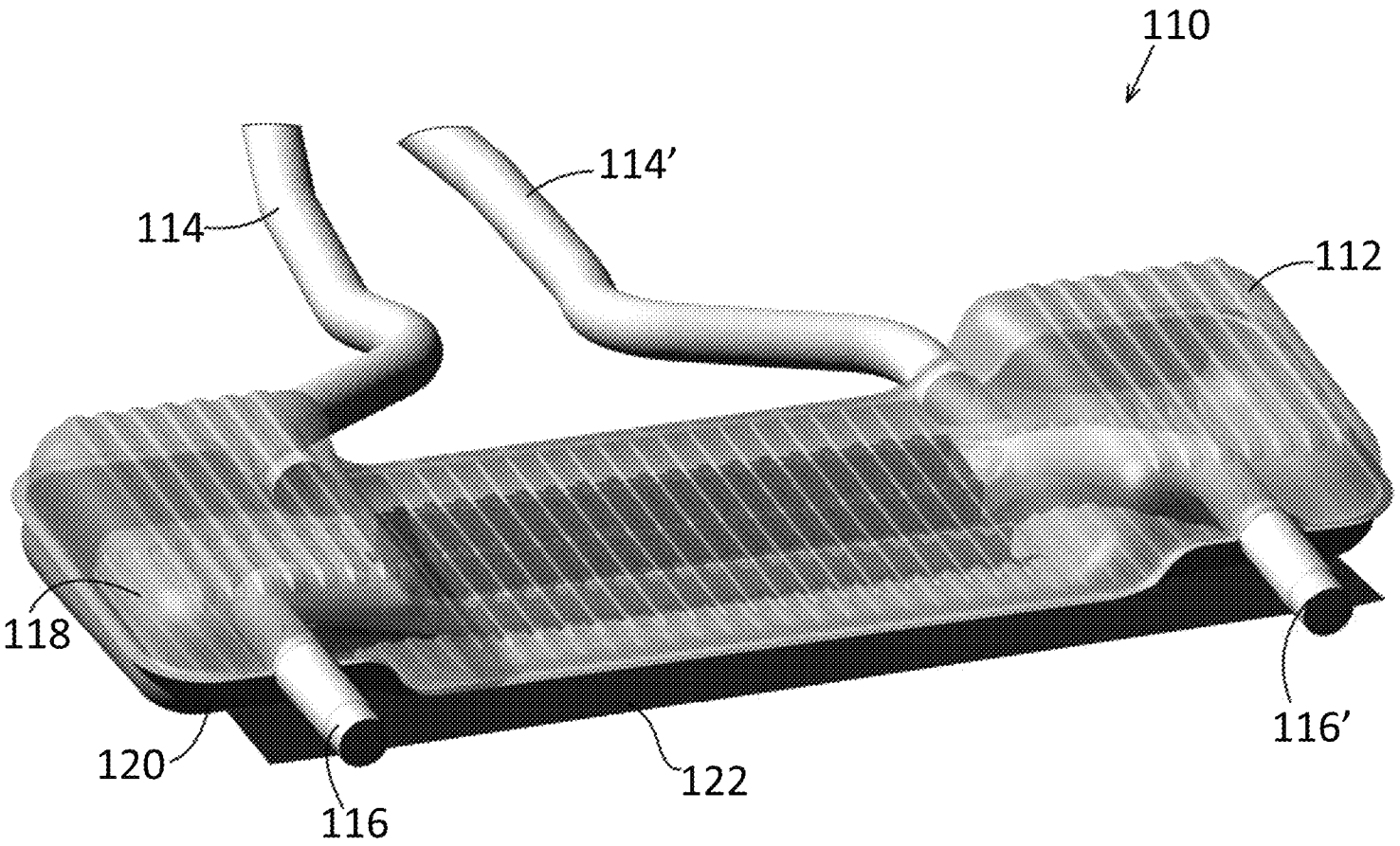
FIG. 8 is a partially ghosted, perspective view of an embodiment of the stamped muffler having dual exhaust inputs and outputs and an air deflecting shield according to the disclosed inventive concept.
Figure 9:
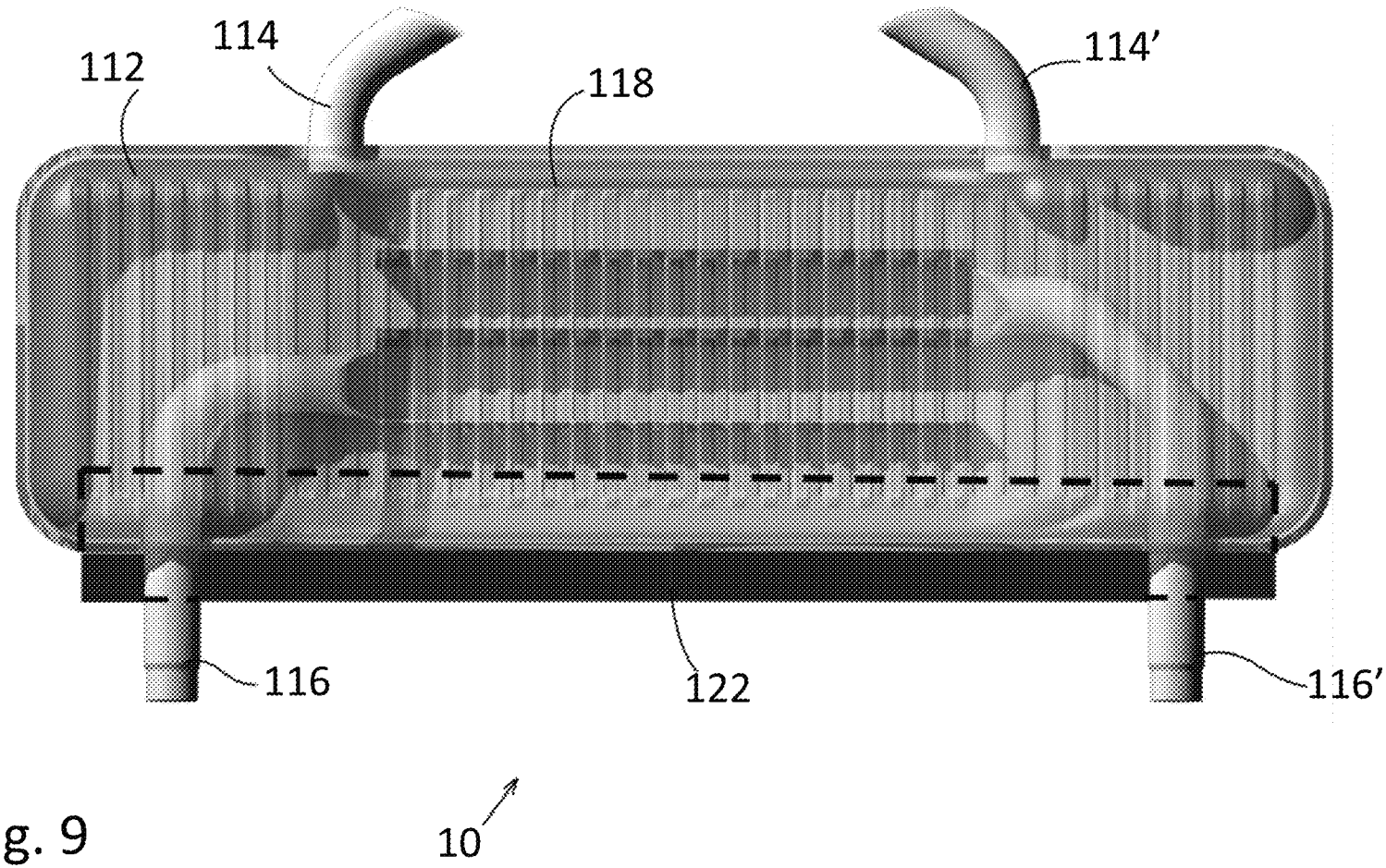
FIG. 9 is a partially ghosted, top view of the embodiment of the stamped muffler having dual exhaust inputs and outputs and an air deflecting shield of FIG. 8.
Figure 10:
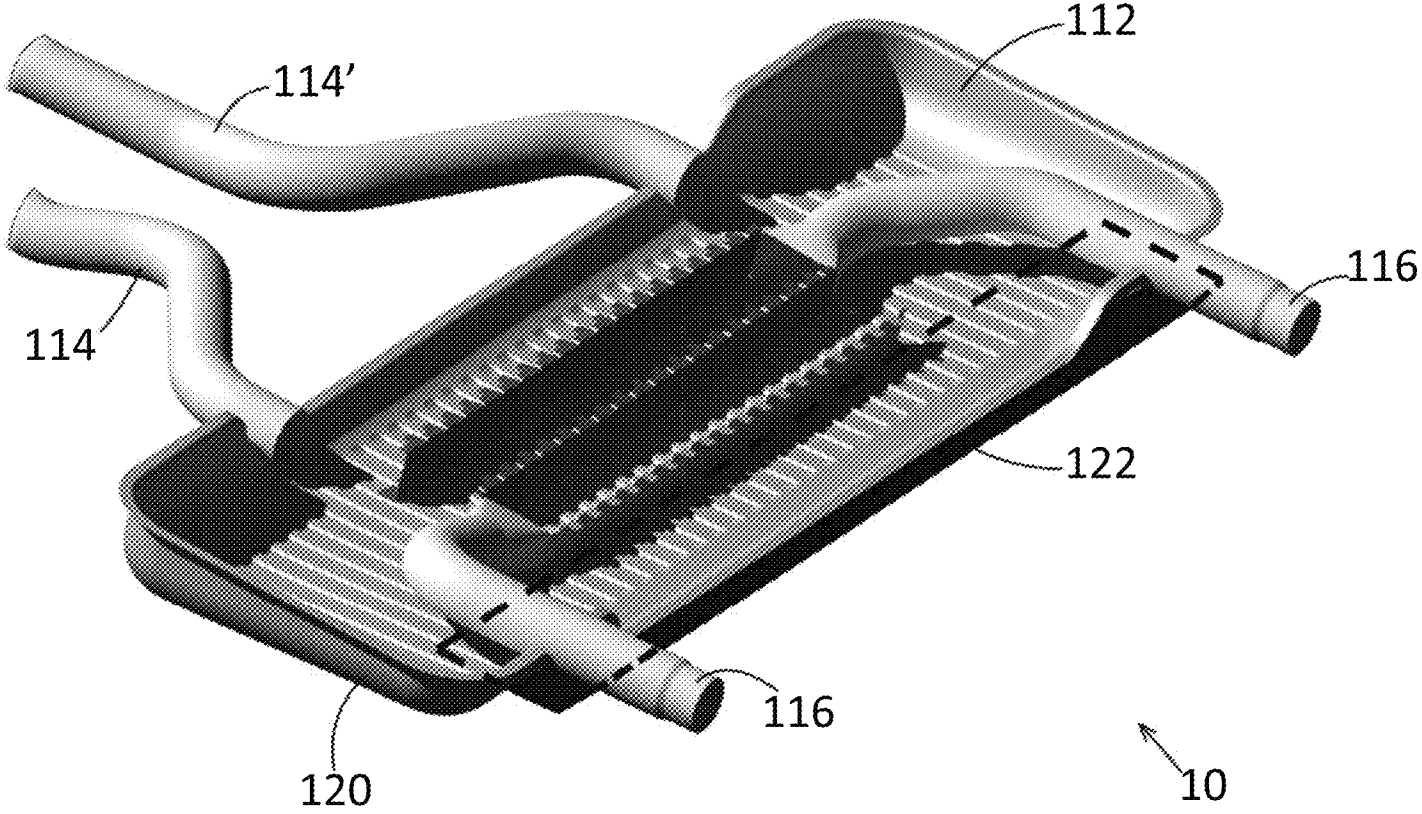
FIG. 10 is a sectional perspective view of the embodiment of the stamped muffler having dual exhaust inputs and outputs and an air deflecting shield of FIG. 8.

As noted above, the disclosed inventive concept applies to a broad variety of muffler types, including both transverse and dual muffler arrangements. However, it is to be understood that the integrated air deflecting shield of the disclosed inventive concept is not to be limited by muffler type. By way of an additional example, FIGS. 8, 9 and 10 illustrated partially ghosted images of a transverse muffler assembly, generally illustrated as 110, fitted with an air deflecting shield that is consistent with the scope of the present invention. Particularly, the transverse muffler assembly 110 includes a muffler 112 having a first exhaust inlet pipe 114, a second exhaust inlet pipe 114', a first tailpipe 116, and a second tailpipe 116'. The stamped muffler 112 includes an upper stamping 118 and a lower stamping 120. A cantilevered air deflecting shield 122 is attached to the underside of the lower stamping 120 by, for example, welding.

Figure 11:
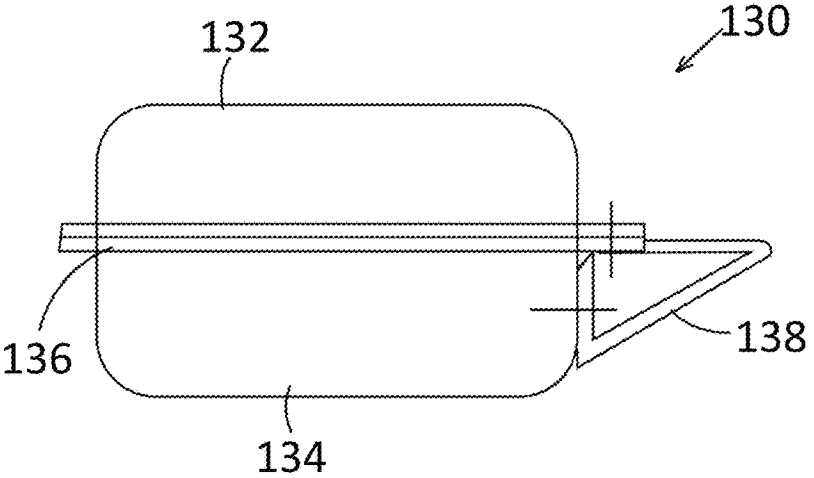
FIG. 11 is a side view of another embodiment of the stamped muffler having an air deflecting shield according to the disclosed inventive concept.

Referring to FIG. 11, a side view of another embodiment of the stamped muffler having an air deflecting shield according to the disclosed inventive concept is illustrated and is generally shown as a stamped, transverse muffler 130. The stamped, transverse muffler 130 includes an upper stamping 132 having attached thereto a lower stamping 134. The upper stamping 132 and the lower stamping 134 are joined at a peripherally extending mating flange 136. A triangular air deflecting shield 138 is attached, such as by welding, to the end portion of the mating flange 136 and to the back wall of the lower stamping 134. The triangular air deflecting shield 138 thus extends vehicle rearward from the end of the mating flange 136.

Figure 12:
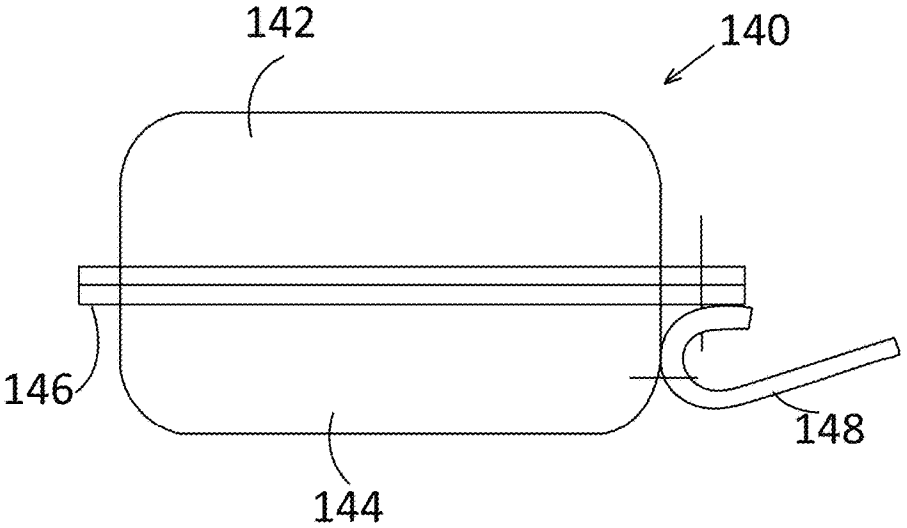
FIG. 12 is a side view of another embodiment of the stamped muffler having an air deflecting shield according to the disclosed inventive concept.

Referring to FIG. 12, a side view of another embodiment of the stamped muffler having an air deflecting shield according to the disclosed inventive concept is illustrated and is generally shown as a stamped, transverse muffler 140. The stamped, transverse muffler 140 includes an upper stamping 142 having attached thereto a lower stamping 144. The upper stamping 142 and the lower stamping 144 are joined at a peripherally extending mating flange 146. A J-shaped air deflecting shield 148 is attached, such as by welding, to the end portion of the mating flange 146 and to the back wall of the lower stamping 144. The J-shaped air deflecting shield 148 thus extends vehicle rearward from the end of the mating flange 146.

Figure 13:
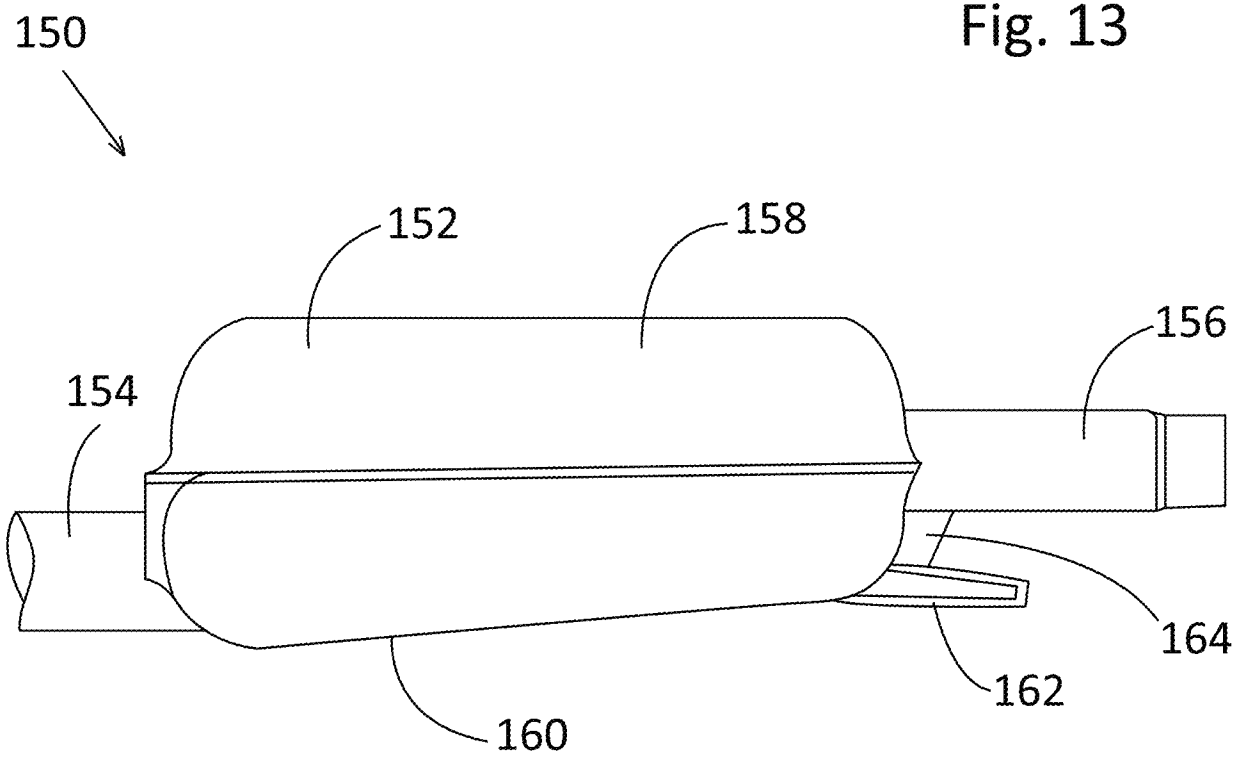
FIG. 13 is a side view of another embodiment of the stamped muffler having an air deflecting shield according to the disclosed inventive concept.

Referring to FIG. 13, a side view of another embodiment of the stamped muffler having an air deflecting shield according to the disclosed inventive concept is illustrated and is generally shown as a muffler assembly 150. The muffler assembly includes a transverse muffler 152 having an exhaust inlet pipe 154 and a tailpipe 156 attached thereto. The transverse muffler 152 includes an upper stamping 158 having attached thereto a lower stamping 160. An air deflecting shield support bracket 162 is attached to the back wall of the lower stamping 160. A V-shaped air deflecting shield 164 is attached, such as by welding, to the support bracket 162 and to the underside of the lower stamping 160. The V-shaped air deflecting shield 164 thus extends vehicle rearward from the end of the lower stamping 160.

In addition to the variations of the transverse or dual muffler assemblies and their associated aerodynamic shield arrangements illustrated in FIGS. 1 through 13, the disclosed inventive concept offers alternative aerodynamic features that are integrated with relative ease into the muffler. Specifically, and referring to FIGS. 14 through 22, various embodiments of a muffler having aerodynamic, drag-reducing design features stamped into the lower stamping are illustrated in different configurations and combinations. The common objective of the drag-reducing design features formed in the lower stamping is to have the passing air become detached from the underside of the muffler as soon as possible so as to optimize the aerodynamic count. It is to be understood that the configurations and combinations illustrated in FIGS. 14 through 22 are only suggestive and are not intended as being limiting insofar as other combinations may be possible without deviating from the spirit and scope of the disclosed inventive concepts.

Figure 14:
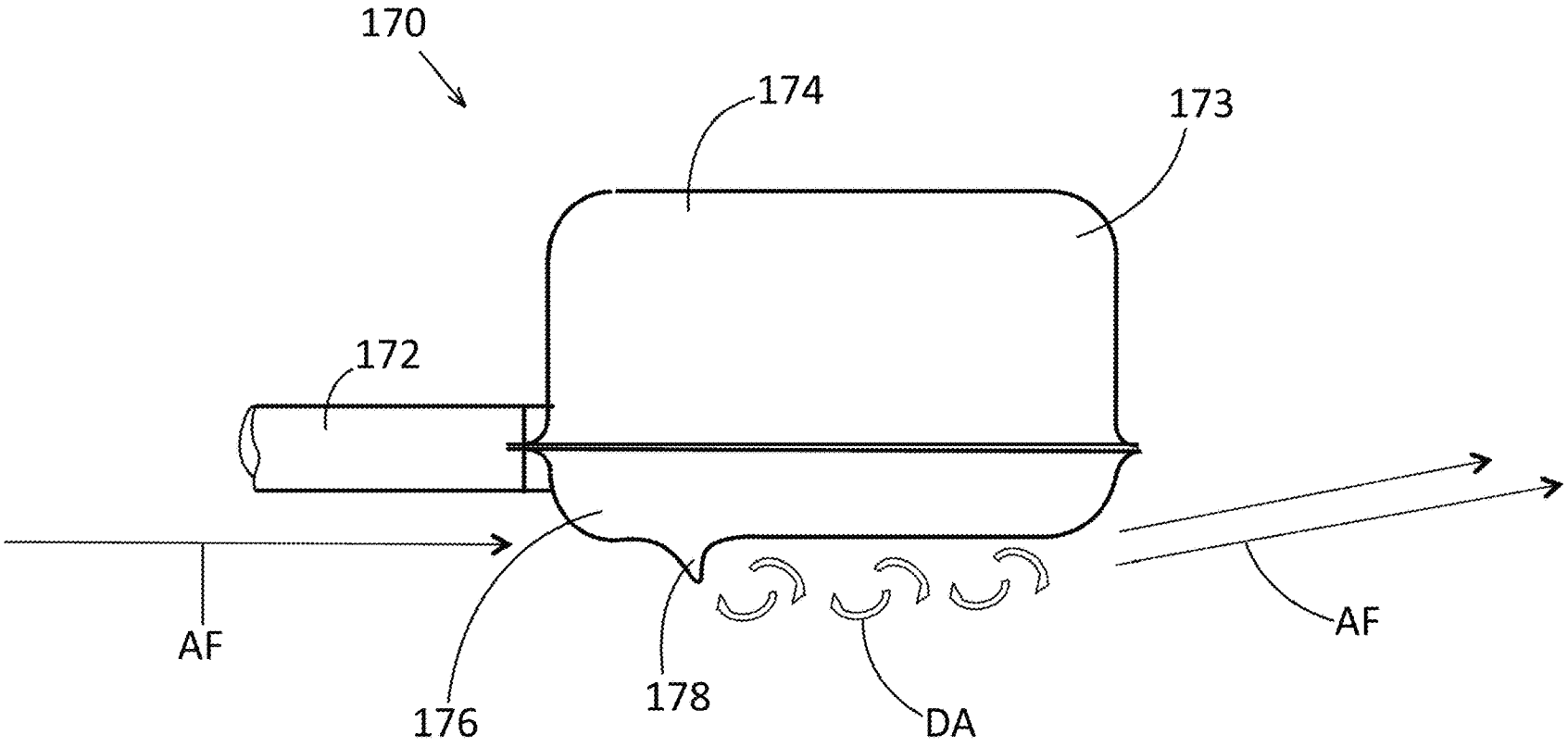
FIG. 14 is a side view of another embodiment of the stamped muffler having an air deflecting shield according to the disclosed inventive concept.

Referring to FIG. 14, a side view of an embodiment of the stamped muffler having an air deflecting shield according to the disclosed inventive concept in which the lower stamping is modified so as to provide improved aerodynamics is shown. A stamped muffler assembly 170 is generally shown which includes an exhaust inlet pipe 172 and an exhaust outlet (not shown). The muffler assembly 170 includes a muffler 173 having an upper stamping 174 and a relatively shallow lower stamping 176. An extended surface 178 extends from the lower stamping 176 and functions as an air dam to detach air DA from the underside of the lower stamping 176, thereby passing it along as an air flow AF. The extended surface 178 is integrally formed with the lower stamping 176.

Figure 15:
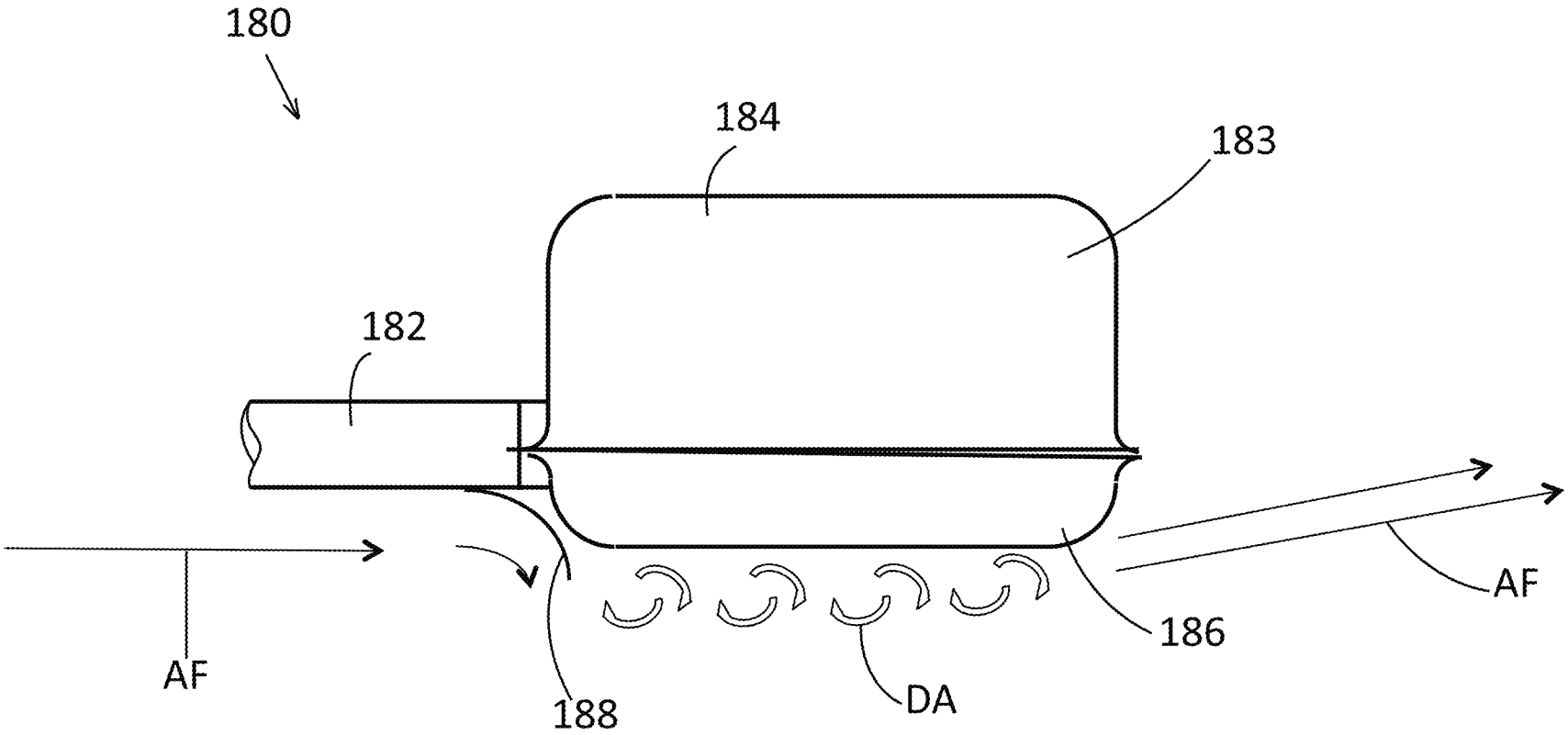
FIG. 15 is a side view of another embodiment of the stamped muffler having an air deflecting shield according to the disclosed inventive concept.

Referring to FIG. 15, a side view of another embodiment of the stamped muffler having an air deflecting shield according to the disclosed inventive concept in which an air deflecting plate has been added forward of the muffler so as to provide improved aerodynamics is shown. A stamped muffler assembly 180 is generally shown which includes an exhaust inlet pipe 182 and an exhaust outlet (not shown). The muffler assembly 180 includes a muffler 183 having an upper stamping 184 and a relatively shallow lower stamping 186. An air deflecting plate 188 is attached to the exhaust inlet pipe 182, such as by welding, at a point forward of the muffler 183. The air deflecting plate 188 functions as an air dam to detach air DA from the underside of the lower stamping 186 as soon as possible, thereby passing it along as an air flow AF.

Figure 16:
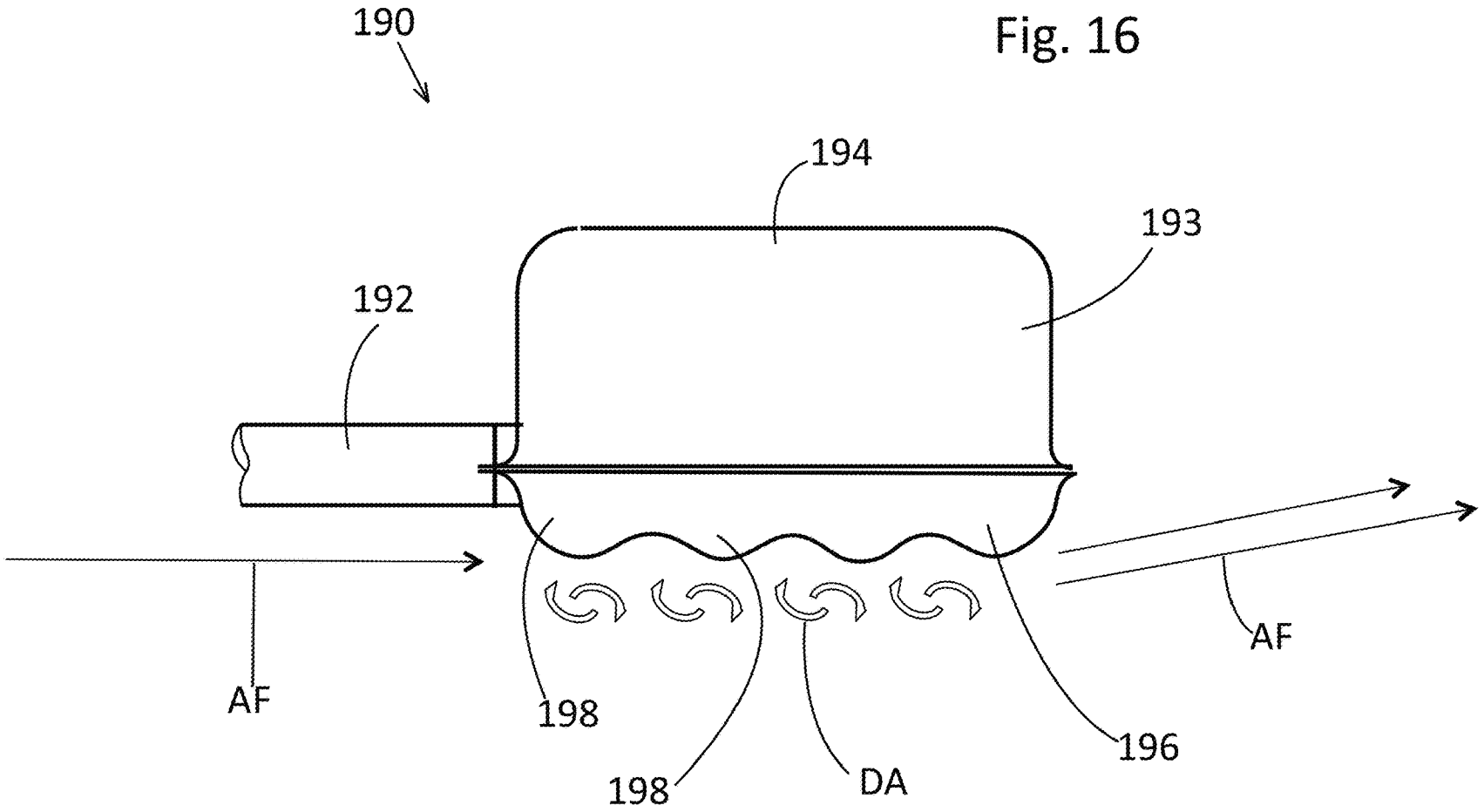
FIG. 16 is a side view of another embodiment of the stamped muffler having an air deflecting shield according to the disclosed inventive concept.
Figure 17:
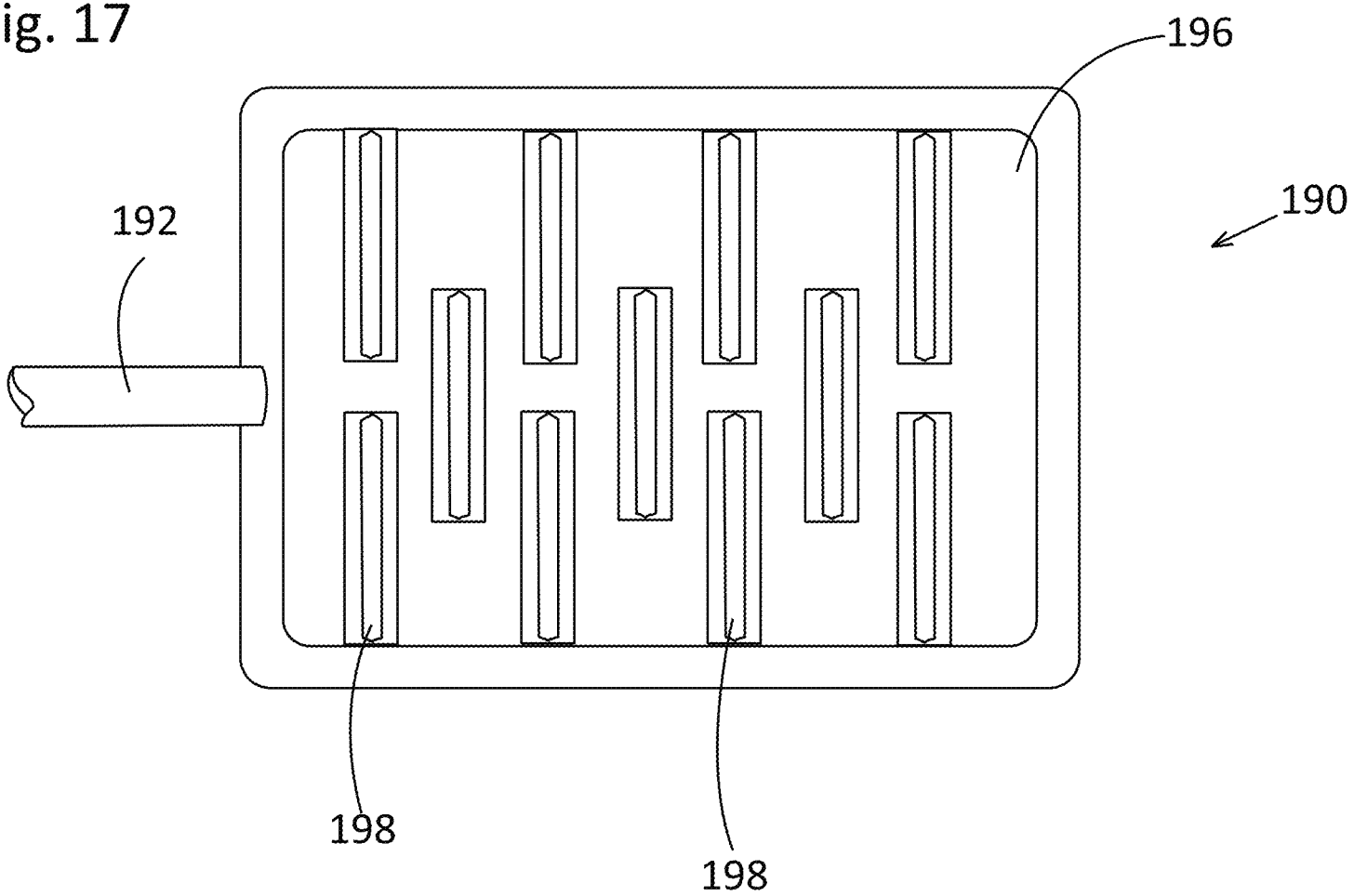
FIG. 17 is an underside view of the embodiment of the stamped muffler having an air deflecting shield shown in FIG. 16.

Referring to FIGS. 16 and 17, a side view and an underside view of another embodiment of the stamped muffler having an air deflecting shield according to the disclosed inventive concept in which a structure has been formed on the underside of the muffler to provide improved aerodynamics are shown respectively. A stamped muffler assembly 190 is generally shown which includes an exhaust inlet pipe 192 and an exhaust outlet (not shown). The muffler assembly 190 includes a muffler 193 having an upper stamping 194 and a relatively shallow lower stamping 196. A series of parallel ridges 198 is integrally formed on the underside of the lower stamping 196. It is to be understood that a greater or lesser number of parallel ridges 198 may be provided than the number illustrated. The parallel ridges 198 may also be narrower than those illustrated. Regardless of their configuration, the parallel ridges 198 detach air DA from the underside of the lower stamping 196 as soon as possible, thereby passing it along as an air flow AF.

Figure 18:
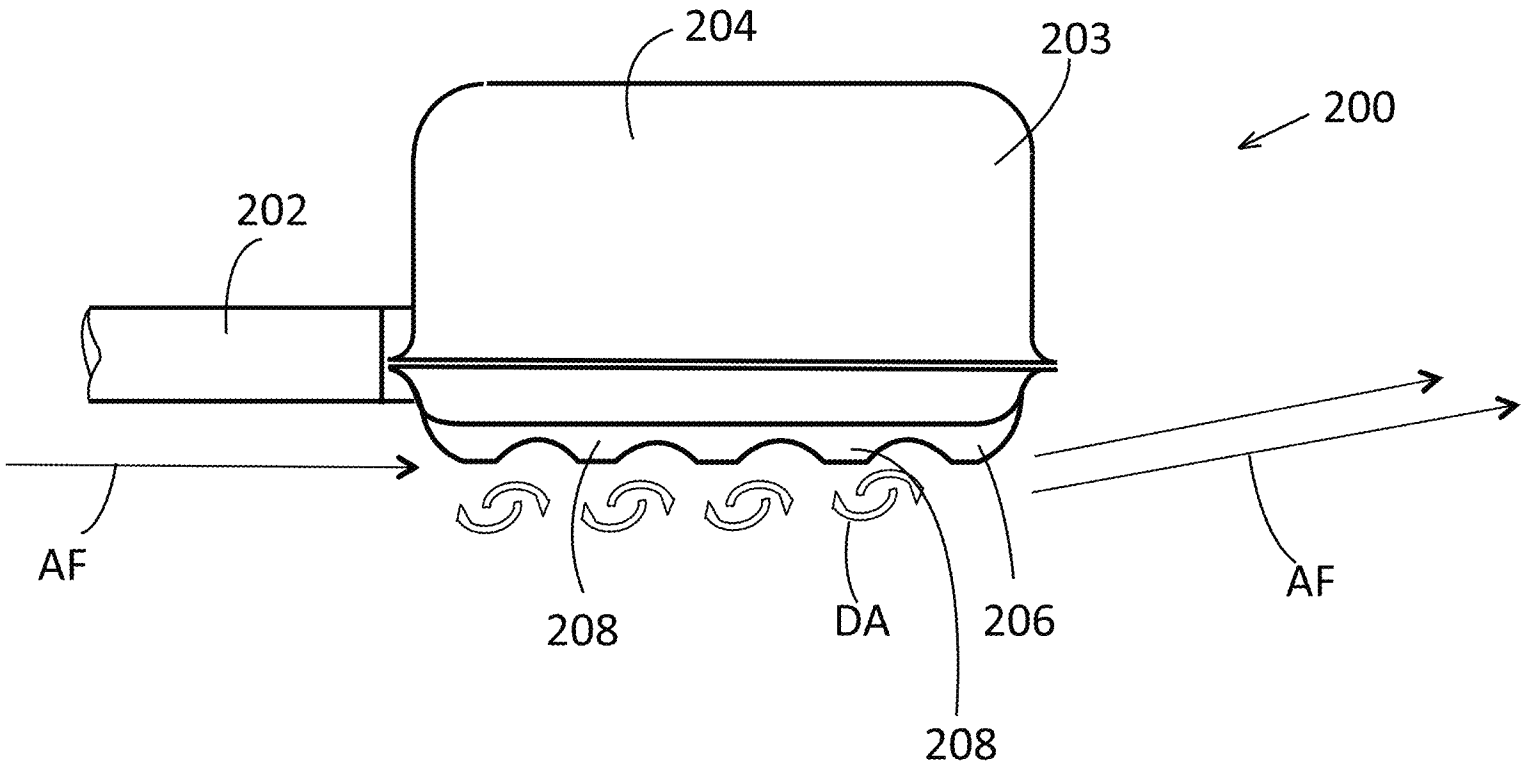
FIG. 18 is a side view of another embodiment of the stamped muffler having an air deflecting shield according to the disclosed inventive concept.
Figure 19:
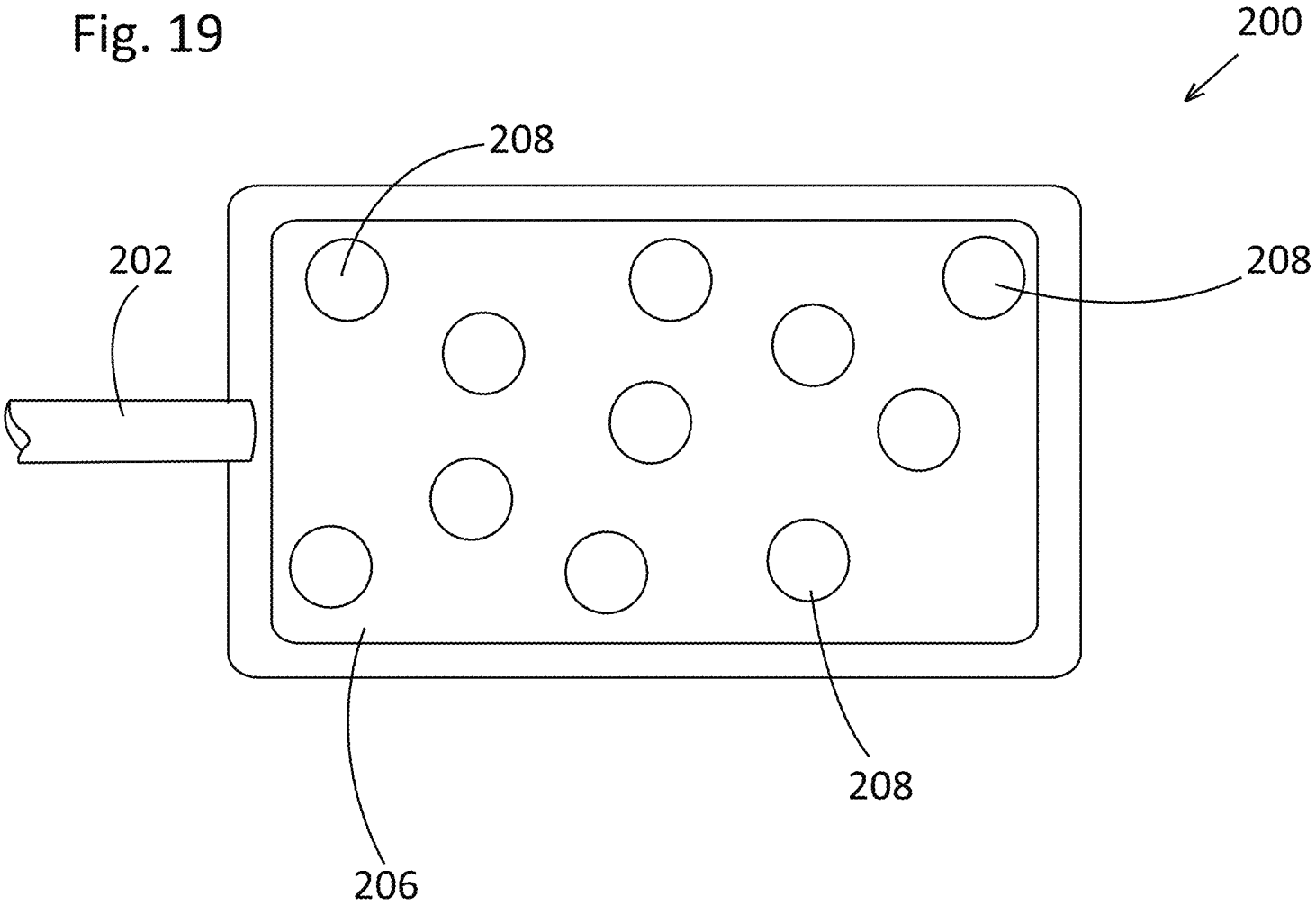
FIG. 19 is an underside view of the embodiment of the stamped muffler having an air deflecting shield shown in FIG. 18.

Referring to FIGS. 18 and 19, a side view and an underside view of another embodiment of the stamped muffler having an air deflecting shield according to the disclosed inventive concept in which an alternative structure has been formed on the underside of the muffler to provide improved aerodynamics are shown respectively. A stamped muffler assembly 200 is generally shown which includes an exhaust inlet pipe 202 and an exhaust outlet (not shown). The muffler assembly 200 includes a muffler 203 having an upper stamping 204 and a relatively shallow lower stamping 206. An array of dimples 208 is integrally formed on the underside of the lower stamping 206. It is to be understood that a greater or lesser number of dimples 208 may be provided than the number illustrated. The dimples 208 may be larger or smaller than those illustrated. Regardless of their configuration, the dimples 208 also detach air DA from the underside of the lower stamping 206 as soon as possible, thereby passing it along as an air flow AF.

As discussed and illustrated, FIGS. 14 through 19 illustrate different configurations of the lower stamping having integral extended surfaces in the forms of an air dam, a deflection plate, and a series of parallel ridges as well as a dimpled surface. An important feature of the disclosed inventive concept is its ability to be modified, adjusted and otherwise tuned to provide a specific amount of drag. Specific tuning may be achieved based upon a combination of two or more of the integral extended surface, the parallel ridges and the dimpled surface. Examples of such combinations are illustrated in FIGS. 20 and 21.

Figure 20:
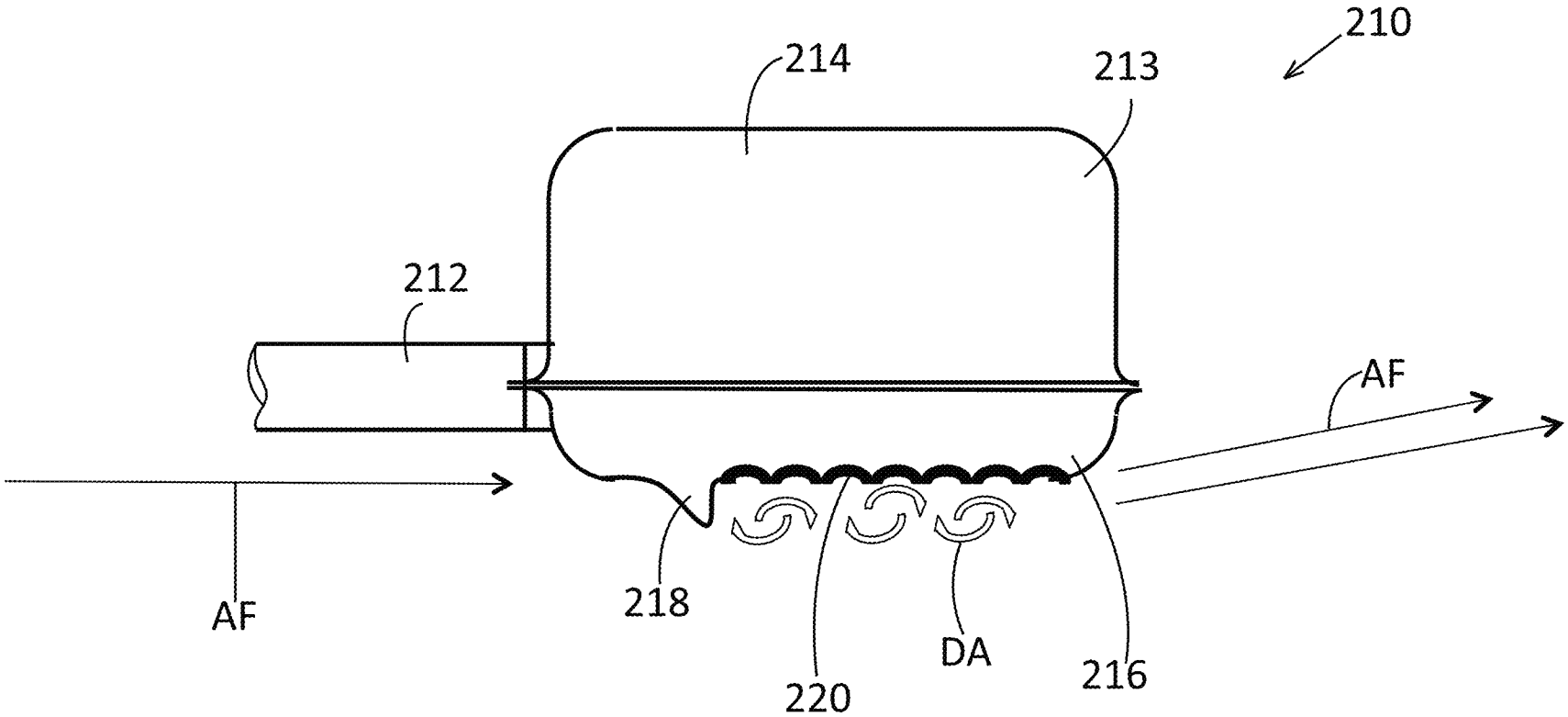
FIG. 20 is a side view of another embodiment of the stamped muffler having an air deflecting shield according to the disclosed inventive concept.

Referring to FIG. 20, a side view of a stamped muffler of the disclosed inventive concept representing another such combination of features is illustrated. The stamped muffler, generally illustrated as 210, includes an exhaust inlet pipe 212, an upper stamping 214, and a relatively shallow lower stamping 216. An extended surface 218 is formed adjacent the forward area of the lower stamping 216 and extends therefrom. An array of dimples 220 is formed on the underside of the lower stamping 216. The extended surface 218, working in conjunction with the array of dimples 220, functions as an air dam to detach air DA from the underside of the lower stamping 216. The detached air DA passes along in an air flow AF. The extended surface 218 and the array of dimples 220 are integrally formed with the lower stamping 216.

Figure 21:
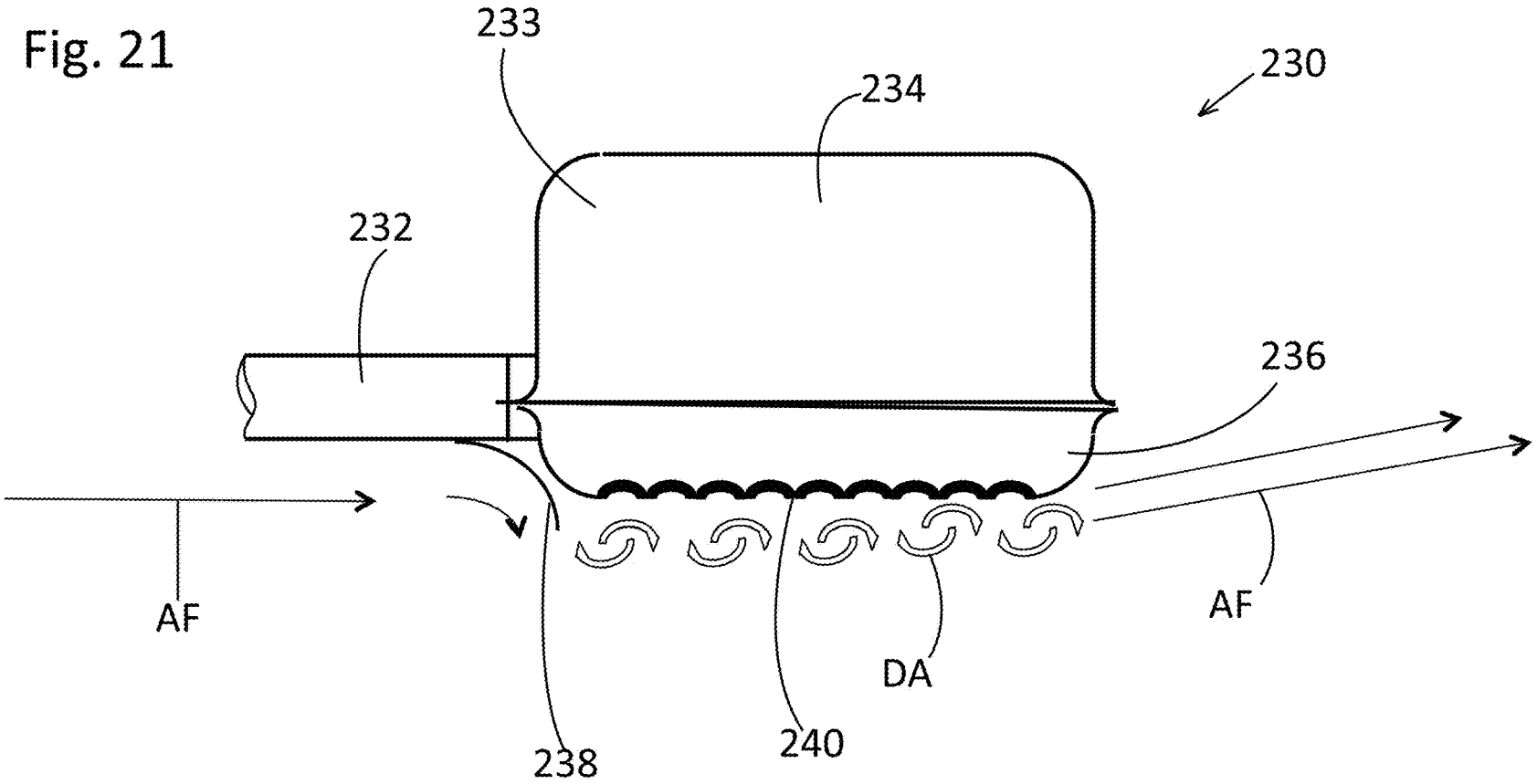
FIG. 21 is a side view of another embodiment of the stamped muffler having an air deflecting shield according to the disclosed inventive concept.

Referring to FIG. 21, a side view of a stamped muffler of the disclosed inventive concept representing still another such combination of features is illustrated. The stamped muffler, generally illustrated as 230, includes an exhaust inlet pipe 232, an upper stamping 234, and a relatively shallow lower stamping 236. An extended surface in the form of an air deflecting plate 238 is attached to the exhaust inlet pipe 232, such as by welding, at a point forward of the muffler 230. An array of dimples 230 is formed on the underside of the lower stamping 230. The air deflecting plate 238, working in conjunction with the array of dimples 240, functions as an air deflector to detach air DA from the underside of the lower stamping 236. The detached air DA passes along in an air flow AF.

The disclosed inventive concept in its various embodiments disclosed in FIGS. 1 through 21 and discussed in relation thereto enhances the inherent aerodynamic function of the large flat surfaces possible in stamped muffler designs. Each of the various tunable embodiments reduces vehicle drag by largely or entirely restricting under body air flow from being captured in the cavity between the rear of the stamped muffler and front of the fascia return flange. In conjunction with the substantially flat bottomed stamped mufflers, the combined function of this invention avoids significant cost through the elimination of separate body exterior rear underbody aero dynamic shields.

One skilled in the art will readily recognize from such discussion, and from the accompanying drawings and claims that various changes, modifications and variations can be made therein without departing from the true spirit and fair scope of the invention as defined by the following claims.

What is claimed is:

1. An aerodynamic muffler comprising:

an upper stamped shell portion;

a lower stamped shell portion attached to said upper stamped shell portion at a flange;

an air deflecting shield extending from and being integrally formed with said flange.

2. The aerodynamic muffler of claim 1 wherein said lower stamped shell portion is a substantially flat portion, said air deflecting shield being integral with and extending therefrom.

3. The aerodynamic muffler of claim 1 wherein said upper stamped shell portion has two opposed sides and said lower stamped shell portion has two opposed sides, said flange extending from said sides of said portions.

4. The aerodynamic muffler of claim 3 wherein said flange has a top side and an underside and wherein said air deflecting shield is attached to said underside.

5. The aerodynamic muffler of claim 1 wherein said air deflecting shield has a flat shape.

6. The aerodynamic muffler of claim 1 further including a shield-supporting bracket attached to said back end of said lower stamped portion, said air deflecting shield being attached to said shield-supporting bracket.

7. An aerodynamic muffler comprising:

an upper stamped shell portion;

a lower stamped shell portion attached to said upper stamped shell portion at a flange, said lower stamped shell portion having a bottom wall, a front end and a back end; and an air deflecting shield extending from and being welded to said flange.

8. The aerodynamic muffler of claim 7 wherein said lower stamped shell portion includes a series of ridges extending from said bottom wall.

9. The aerodynamic muffler of claim 7 wherein said lower stamped shell portion includes a series of dimples formed on said bottom wall.

10. An aerodynamic muffler comprising:

an upper shell portion;

a lower shell portion attached to said upper shell portion, said lower stamped shell portion having a bottom wall;

an air deflector having a front wall, a back wall, a base wall interconnecting said front wall and said back wall, and a shield extension extending from said base wall, said base wall extending along said bottom wall of said lower shell portion, at least one of said front wall, said back wall, and said base wall being attached to said lower shell portion.

11. The aerodynamic muffler of claim 10 wherein said shield extension is a flat shield extending from said base wall.

12. The aerodynamic muffler of claim 1 wherein said air deflecting shield has a triangular shape.

13. The aerodynamic muffler of claim 1 wherein said air deflecting shield has a J-shape.

14. The aerodynamic muffler of claim 1 wherein said air deflecting shield has a V-shape.

15. The aerodynamic muffler of claim 7 wherein said air deflecting shield has a flat shape.

16. The aerodynamic muffler of claim 7 wherein said air deflecting shield has a triangular shape.

17. The aerodynamic muffler of claim 7 wherein said air deflecting shield has a J-shape.

18. The aerodynamic muffler of claim 7 wherein said air deflecting shield has a V-shape.

* * * * *